United States Patent [19]

Skatsche et al.

[11] Patent Number: 4,480,601

[45] Date of Patent: Nov. 6, 1984

[54] WATER-COOLED TWO-STROKE INTERNAL COMBUSTION ENGINE

[75] Inventors: Othmar Skatsche; Gerhard Feichtinger, both of Graz, Austria

[73] Assignees: Avl Gesellschaft Fur Verbrennungskraftmaschinen Und Messtechnik m.b.H.; Prof.Dr.Dr.h.c. Hans List, both of Graz, Austria

[21] Appl. No.: 563,932

[22] Filed: Dec. 21, 1983

[30] Foreign Application Priority Data

Jan. 11, 1983 [AT] Austria ..... 82/83

[51] Int. Cl.[3] ..... F02B 75/20; F02B 75/18; F01P 1/02

[52] U.S. Cl. ..... 123/59 B; 123/41.74; 123/41.67

[58] Field of Search ..... 123/59 B, 41.74, 41.81, 123/41.83, 41.84, 41.67

[56] References Cited

U.S. PATENT DOCUMENTS

| | | | |
|---|---|---|---|
| Re. 16,281 | 3/1926 | Luce et al. | 123/59 B |
| 1,390,572 | 9/1921 | Luce et al. | 123/59 B |
| 1,544,482 | 6/1925 | Reineke | 123/59 B |
| 1,654,156 | 12/1927 | Andersen | 123/59 B |
| 2,727,499 | 12/1955 | Waller | 123/59 B |
| 4,131,090 | 12/1978 | Jarnuszkiewicz | 123/59 B |

FOREIGN PATENT DOCUMENTS

| | | | |
|---|---|---|---|
| 679642 | 8/1939 | Fed. Rep. of Germany | 123/59 B |

*Primary Examiner*—Wendell E. Burns
*Attorney, Agent, or Firm*—Watson, Cole, Grindle & Watson

[57] ABSTRACT

A two cylinder engine has a reverse scavenging system with exhaust ports positioned on either front end of the cylinder block and directed towards areas without any ports which are located next to each other in the center of the engine. Intake ports are directed towards either side wall of each cylinder where they open into charge compartments which are closed, e.g., with covers whose dimensions will permit milling and core-pulling tools to have access to the intake ports. Between the port-free areas of the cylinders a gap is provided which connects the water jackets of the cylinders in the upper part and the charge compartments in the lower part thereof.

2 Claims, 4 Drawing Figures

WATER-COOLED TWO-STROKE INTERNAL COMBUSTION ENGINE

BACKGROUND OF THE INVENTION

This invention relates to a two-stroke water-cooled internal combustion engine comprising two cylinders and intake and exhaust ports controlled by the pistons, the intake ports being positioned on either side of the exhaust ports which in turn are located on the front ends of the engine, and the intake ports being furthermore directed towards the side walls of the engine, and those areas of the cylinders which do not have any ports being situated next to each other in the center of the engine.

DESCRIPTION OF THE PRIOR ART

In conventional two-stroke combustion engines with reverse scavenging (according to the Schnürle system) the cylinder liners are provided with intake and exhaust ports which are opened or closed by the piston in dead center position, facilitating the exchange of gas in the cylinder. The intake ports are located on either side of the exhaust ports which are faced by an area of the cylinder wall without any ports, along which the incoming fresh charge will rise, forcing the combustion gases towards the exhaust ports and scavenging the entire cylinder.

In German Patent Specification No. 679 642 a variant of a combustion engine of the above type is described in which the cylinder block may be built with integral cylinder liners, since both intake and exhaust ports are accessible from outside. This type of design will allow the use of a permanent mould for the casting of light alloys, including casting of the ports on account of the high precision which may be achieved with this technique. Besides, the ports may also be machined since this particular lay-out will permit the access of milling tools. In addition to the above advantages this kind of port arrangement will enable the distance between the two cylinders to be kept very small since the thin-walled cylinder areas are adjacent to each other. Due to this small distance it will be possible to run the crankshaft without the use of an intermediate bearing between the cylinders, as opposed to the conventional arrangement of the ports in separate cylinder liners, in which case provisions will have to be taken for the greater wall-thickness of the area of the ports, the sealing of the cylinder liners and an air compartment with good conditions of flow into the ports.

The main disadvantage of the known set-up is that each intake port of the two cylinders on either side of the cylinder block must be provided with a separate feed pipe for the fresh charge, which will considerably complicate the design.

SUMMARY OF THE INVENTION

It is an object of the present invention to avoid the disadvantages of the above type of combustion engine, above all the need for separate feed pipes for the fresh charge.

According to the present invention this is achieved by placing compartments holding the fresh charge on both sides of the engine, into which the intake ports will open, and by providing a gap between the areas of the cylinders carrying no ports, which will connect the water jackets of the two cylinders in the upper half while it will connect the two charging compartments in the lower half.

With this type of arrangement a single feed pipe will suffice for taking the fresh air to the charging compartments which are connected via the gap in the lower part of the cylinders. A solid connection between between the two cylinders in the upper range should be avoided since this would lead to an undesirable accumulation of mass between the cylinders.

The particular design of the intake ports, i.e., their opening into a common charging department, has been proposed before, e.g., in German Patent Specification No. 1 123 158; the same applies for another feature which is described in another variant of the above mentioned German Patent Specification No. 679 642, proposing that a gap be provided between the areas of the cylinders without any ports which will connect the water jackets of the two cylinders.

In a preferred embodiment of the present invention the charging compartments on either side of the combustion engine may be closed with covers whose size is such that the intake ports are accessible with milling or core pulling tools.

DESCRIPTION OF THE DRAWING

The following is a more detailed description of an embodiment of the invention as illustrated by the enclosed drawing in which.

Figure 1:
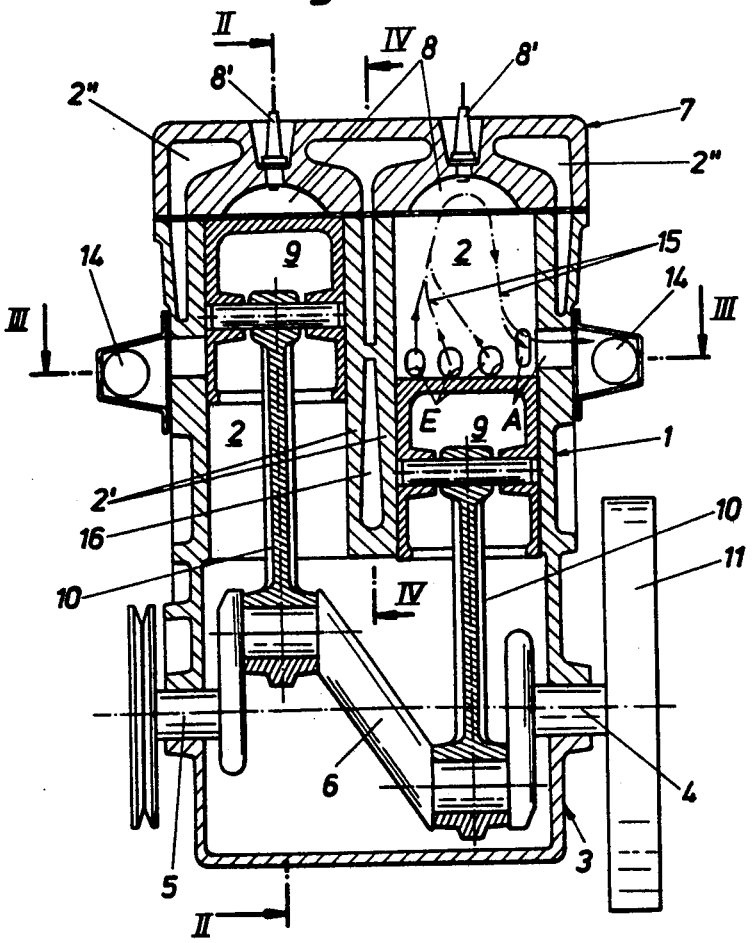
FIG. 1 is a vertical longitudinal section of a two-stroke combustion engine according to this invention.

A cylinder block 1 with two cylinders 2 is provided with an oil sump 3 at its bottom, the parts being joined in the area of two crankshaft bearings 4,5. A crankshaft which is only drawn schematically, is given the number 6. On top the two cylinders 2 are covered by one common cylinder head 7 which in the embodiment shown in this drawing also contains combustion chambers 8 which are shaped like the cap of a sphere and into each of which is projection a spark plug 8'. In the case of a diesel engine the combustion chamber may also be located in the piston and the spark plug may be replaced by an injection nozzle. Pistons 9 are connected to the crankshaft 6 via connecting rods 10. A flywheel is marked with the number 11.

Figure 3:
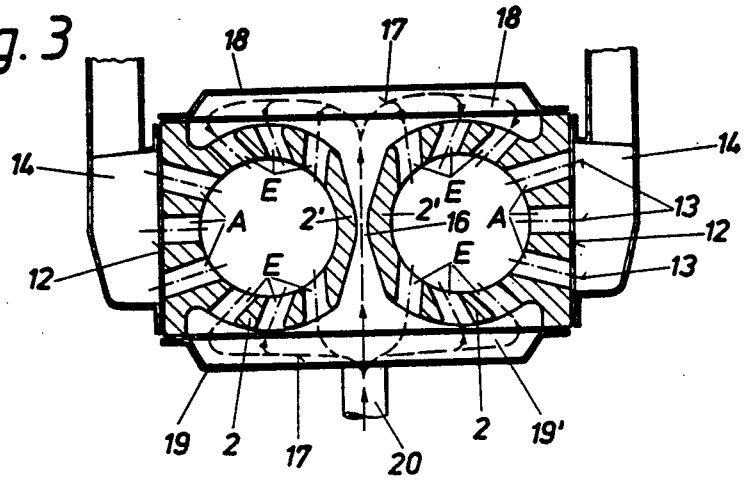
FIG. 3 is a section along line III—III in FIG. 1.
Figure 2:
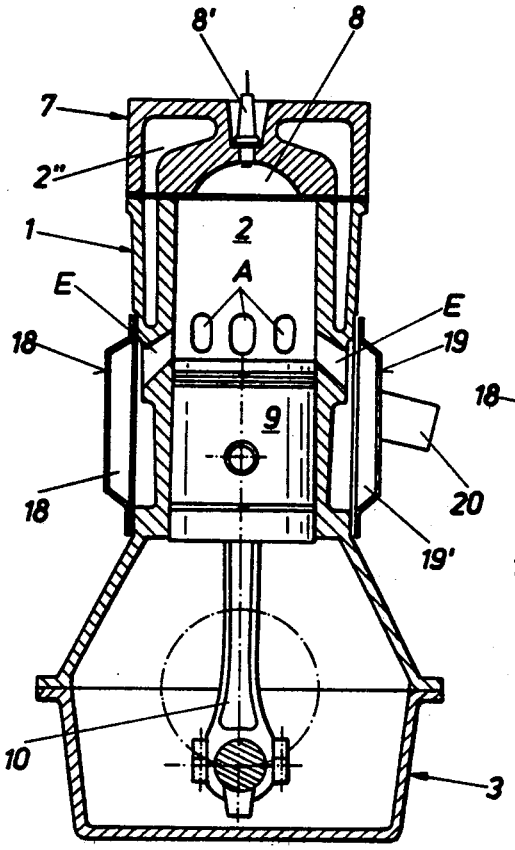
FIG. 2 is a section along line II—II in FIG. 1.
Figure 4:
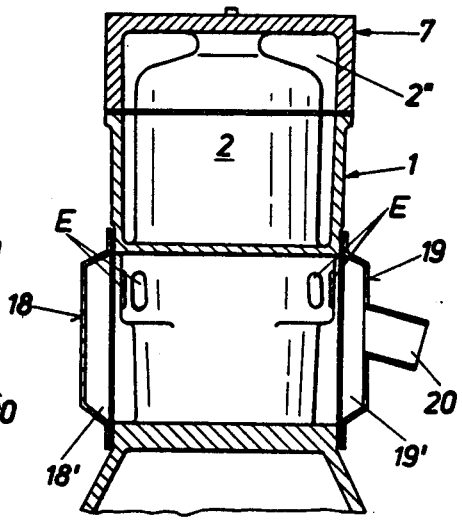
FIG. 4 is a partial section along line IV—IV in FIG. 1.

Intake ports for the air or air/fuel mixture are marked with the letter E, exhaust ports are marked with an A. As can be seen in FIG. 3, six intake ports E are assigned to each cylinder 2, which are directed towards areas 2' of the cylinders 2 in which no ports have been provided. Threee exhaust ports A are placed on each front end 12 of the combustion engine, the axes of these ports converging towards areas 2' of the cylinders 2. On both front ends 12 exhaust manifolds 14 are attached. The longitudinal side walls of the engine carry covers 18 and 19, respectively, which form charging compartments 18' and 19', into which the intake ports E on either side of the engine will open. The fresh charge is fed to the charging compartment 19' via connecting pipe 20. The two cylinders 2 are positioned such that their areas 2' which have no ports, are situated next to each other, leaving a gap 16 between them. This gap 16 is used as a channel for conveying the fresh charge to the charging compartment 18', cf. arrows 17 and 17'.

As is indicated in FIG. 1 by arrows 15, the fresh charge will flow through the intake ports E towards area 2' of the cylinders 2, upon which it will flow upwards through the combustion chamber 8, and will then flow back downwards in the direction of the exhaust ports 4. At the same time, the burnt fuel/air mixture displaced by this movement will flow through the exhaust ports A towards exhaust manifold 14.

By way of gap 16 the water jackets 2'' of the cylinders 2 are connected to wach other in the upper part of the cylinders, which will ensure regular circulation of the cooling water.

We claim:

1. A water-cooled two-stroke internal combustion engine comprising two cylinders each having a water jacket, intake ports and exhaust ports and a piston which controls said ports, said intake ports being positioned on either side of said exhaust ports which in turn are located on front ends of the engine, said intake ports being directed towards longitudinal sides of the engine, and said cylinders having areas which do not have any of said ports, said areas being situated next to each other in the center of the engine, said engine further comprising fresh charge compartments located on either of said longitudinal sides and into which said intake ports open, and wherein a gap is provided between said port-free areas of said cylinders, which connects said water jackets of said two cylinders in the upper part and said two charge compartments in the lower part thereof.

2. A two-stroke internal combustion engine according to claim 1, further comprising covers which close said charge compartments, the size of said covers is such that said intake ports are accessible with milling or core pulling tools.

* * * * *

UNITED STATES PATENT AND TRADEMARK OFFICE

CERTIFICATE OF CORRECTION

PATENT NO. : 4,480,601

DATED : Nov. 6, 1984

INVENTOR(S) : Othmar Skatsche and Gerhard Feichtinger

It is certified that error appears in the above-identified patent and that said Letters Patent is hereby corrected as shown below:

In the title page, assignee should read:
--Assignee: AVL GESELLSCHAFT FUR VERBRENNUNGSKRAFTMASCHINEN UND MESSTECHNIK M.B.H., Prof. Dr.Dr.h.c. Hans List, Graz, AUSTRIA--

Signed and Sealed this

*Seventh* Day of *May 1985*

[SEAL]

*Attest:*

DONALD J. QUIGG

*Attesting Officer* *Acting Commissioner of Patents and Trademarks*